US012604955B2

(12) United States Patent
Hashish

(10) Patent No.: US 12,604,955 B2
(45) Date of Patent: Apr. 21, 2026

(54) SYSTEM AND METHOD OF EXPANDABLE CONTAINERS INCLUDING SLIDING PANELS

(71) Applicant: Rami Hashish, Los Angeles, CA (US)

(72) Inventor: Rami Hashish, Los Angeles, CA (US)

( * ) Notice: Subject to any disclaimer, the term of this patent is extended or adjusted under 35 U.S.C. 154(b) by 89 days.

(21) Appl. No.: 18/213,174

(22) Filed: Jun. 22, 2023

(65) Prior Publication Data

US 2024/0156225 A1 May 16, 2024

Related U.S. Application Data

(60) Provisional application No. 63/425,575, filed on Nov. 15, 2022.

(51) Int. Cl.
*A45C 7/00* (2006.01)
*B65D 21/08* (2006.01)

(52) U.S. Cl.
CPC ..... *A45C 7/0031* (2013.01); *B65D 21/08* (2013.01)

(58) Field of Classification Search
CPC ..... A45C 13/34; A45C 5/06; A45C 11/08; A45C 11/38; A45C 13/06; A45C 13/103; A45C 7/0031; B65D 21/08
USPC ..... 190/100, 104, 103
See application file for complete search history.

(56) References Cited

U.S. PATENT DOCUMENTS

| | | | | |
|---|---|---|---|---|
| 9,839,269 | B2 * | 12/2017 | Chen | A45C 5/03 |
| 2020/0022473 | A1 * | 1/2020 | Hashish | A45C 13/04 |
| 2021/0274901 | A1 * | 9/2021 | Petrolino | A45C 7/0022 |

* cited by examiner

*Primary Examiner* — Don M Anderson
*Assistant Examiner* — Jessica Kavini Tamil
(74) *Attorney, Agent, or Firm* — Cohen IP Law Goup PC; Michael N. Cohen

(57) ABSTRACT

An expandable container. The expandable container includes a front base plate, and a left side panel, an upper left corner panel, a top side panel, an upper right corner panel, a right side panel, a lower right corner panel, a bottom side panel, and a lower left corner panel, all of which are movable relative to the base plate using guide rails. The expandable container also includes a movement mechanism that moves the left, top, right, and bottom side panels outward from the base plate. Movement of the left, top, right, and bottom side panels causes movement of the upper left, upper right, lower right, and lower left corner panels outward from the base plate. Such outward movement increases the inner volume of the expandable container. The expandable container is implemented as an expandable suitcase.

20 Claims, 16 Drawing Sheets

SYSTEM AND METHOD OF EXPANDABLE CONTAINERS INCLUDING SLIDING PANELS

CROSS-REFERENCE TO RELATED APPLICATIONS

This application claims priority to U.S. Provisional Application No. 63/425,575 filed Nov. 15, 2022, the entire contents of which are hereby fully incorporated herein by reference for all purposes.

FIELD OF THE INVENTION

This invention relates to containers, including expandable containers such as expandable carrying cases.

BACKGROUND

It is well known that different sized containers may be used for different volumes of items or different types of items to be stored.

In one example, it is well known that different sizes of luggage may be used for different occasions. For instance, a smaller sized piece of luggage may be used to take on an overnight trip when only a limited number of items may need to be carried in the container. Alternatively, a larger piece of luggage may be required for a longer trip that may require a larger number of items to be carried.

This may result in the need for a person to purchase and own several different pieces of luggage of varying sizes. It is not uncommon for a person to own at least three sizes of luggage, such as a small "personal" sized piece of luggage, a medium sized "carry-on piece of luggage, and a large check-in piece of luggage. However, this may be costly due to the fact that three different pieces of luggage are required to be purchased and owned. The multiple pieces of luggage may also take up a lot of space in the person's home.

Some luggage may be available that may expand in volume, but the luggage may only expand in one dimension and by a very limited amount. Other luggage may expand but lose mechanical and/or structural integrity upon expansion.

Accordingly, there is a need for a container that may expand in volume in more than one dimension. There is also a need for a container to expand in more than one dimension while maintaining its mechanical and structural integrity.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
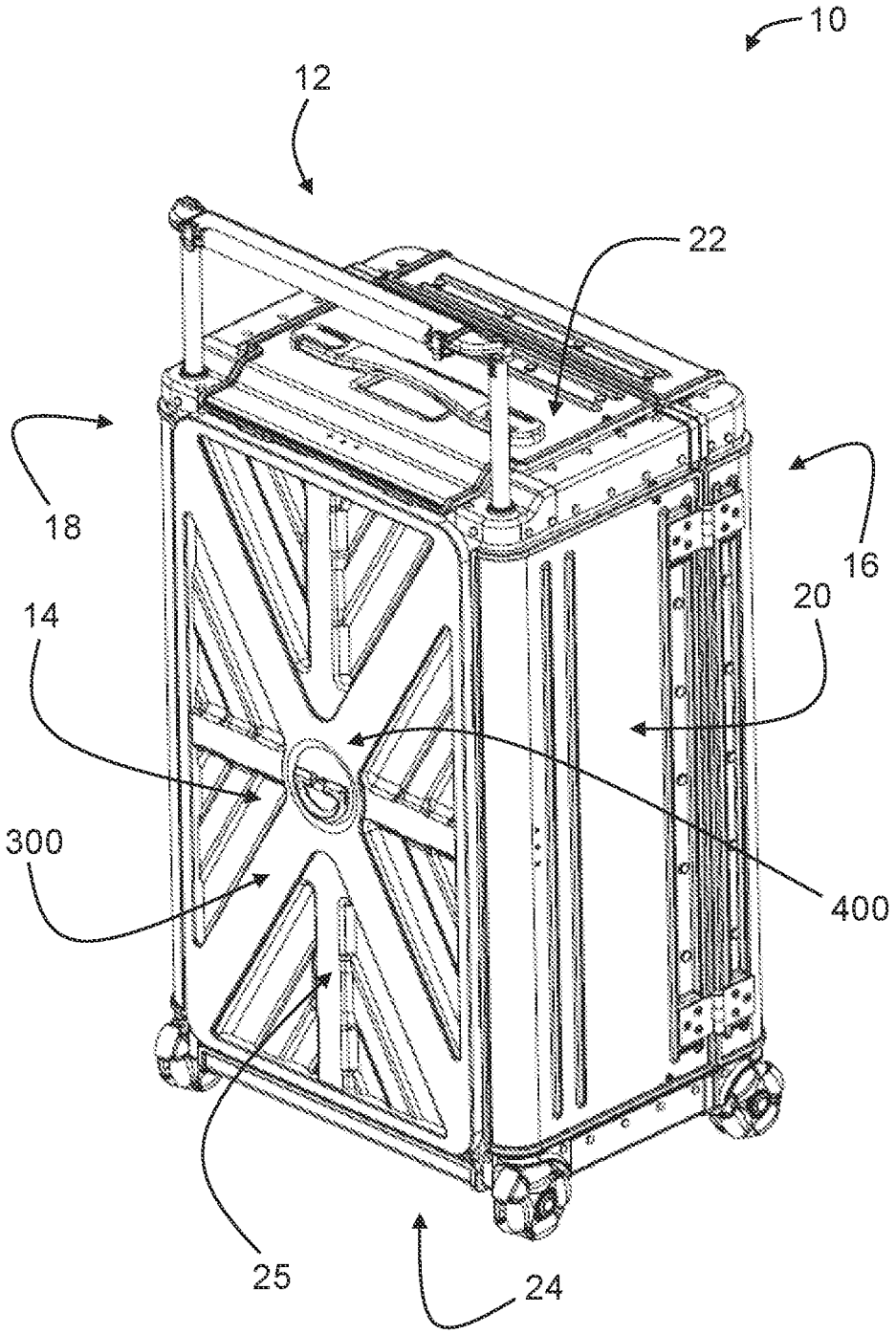
FIG. 1 shows a schematic of an expandable container according to exemplary embodiments hereof.

In some embodiments, as shown in FIG. 1, the assembly 10 includes an expandable case 12 including a back side 14, a front side 16, a left side 18, a right side 20, a top side 22, and a bottom side 24 that in combination define an inner volume V1. As will be described in other sections, one or more of the sides 14, 16, 18, 20, 22, 24 are expandable thereby increasing the inner volume V1. The assembly 10 also includes a back base member 25 that supports one or more sides 14, 16, 18, 20, 22, 24 as the sides 14, 16, 18, 20, 22, 24 are caused to move as described herein.

In some embodiments, as shown in FIG. 1, the expandable case 12 includes a first panel assembly 300 and a first expansion control mechanism 400, each configured with the back base member 25. For the purposes of this specification, the first panel assembly 300 will be described primarily as implemented with the back side 14, the left side 18, the right side 20, the top side 22, and the bottom side 24 with the understanding that a second panel assembly may be implemented with the front side 16 to provide the same or similar functionalities to the front side 16 and to other associated areas of the assembly 10. This will be described in other sections.

Figure 2:
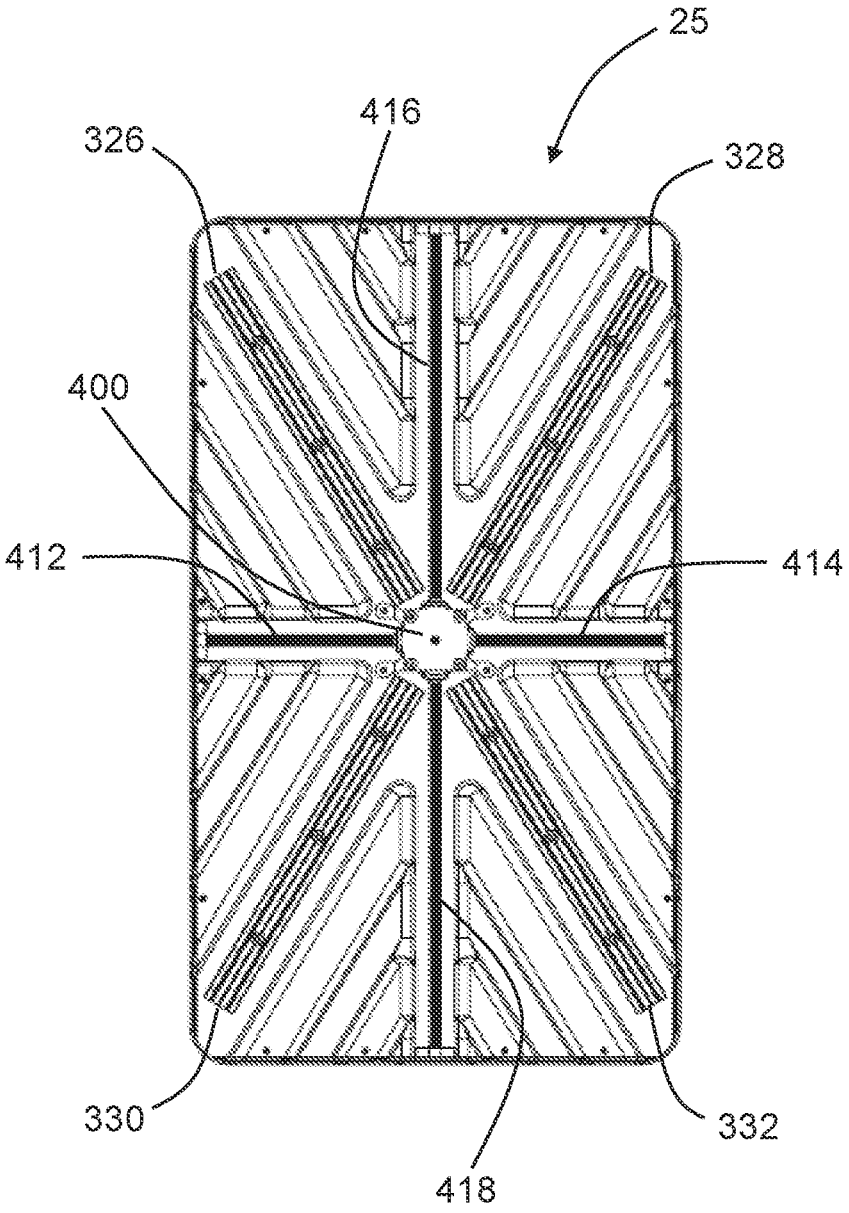
FIG. 2 shows aspects of a base plate according to exemplary embodiments hereof.

FIG. 2 shows the inner side (the side facing the inner volume V1), of the back base member 25. In some embodiments, the back base member 25 includes a solid plate. In some embodiments, the back base member 25 may be formed as a rectangle to generally correspond to the shape of the case's front side 14, but it is understood that the back base member 25 may be formed as any shape as required. As will be described herein, the back base member 25 provides support to the first panel assembly 300 and the first expansion control mechanism 400.

Figure 3:
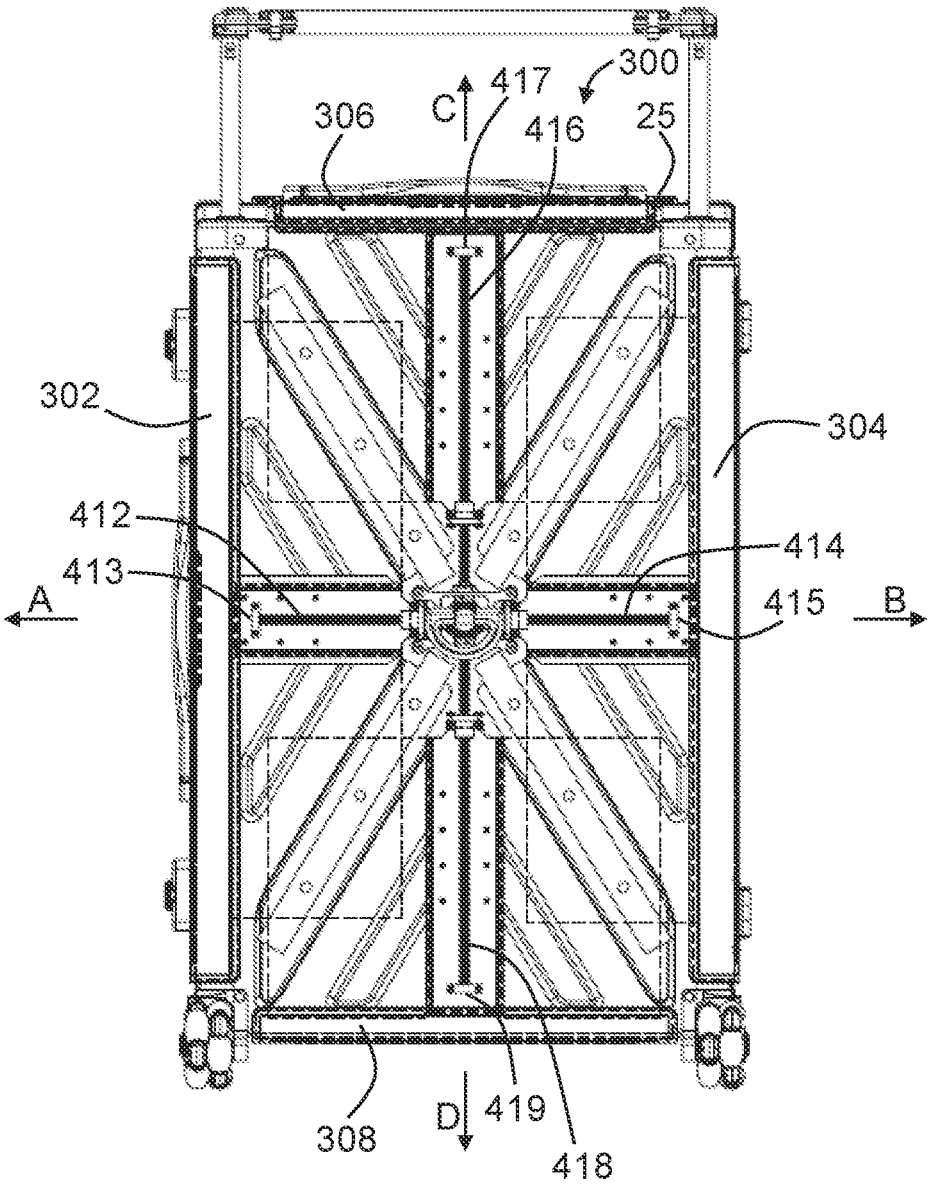
FIG. 3 shows aspects of side panels of an expandable container according to exemplary embodiments hereof.
Figure 4:
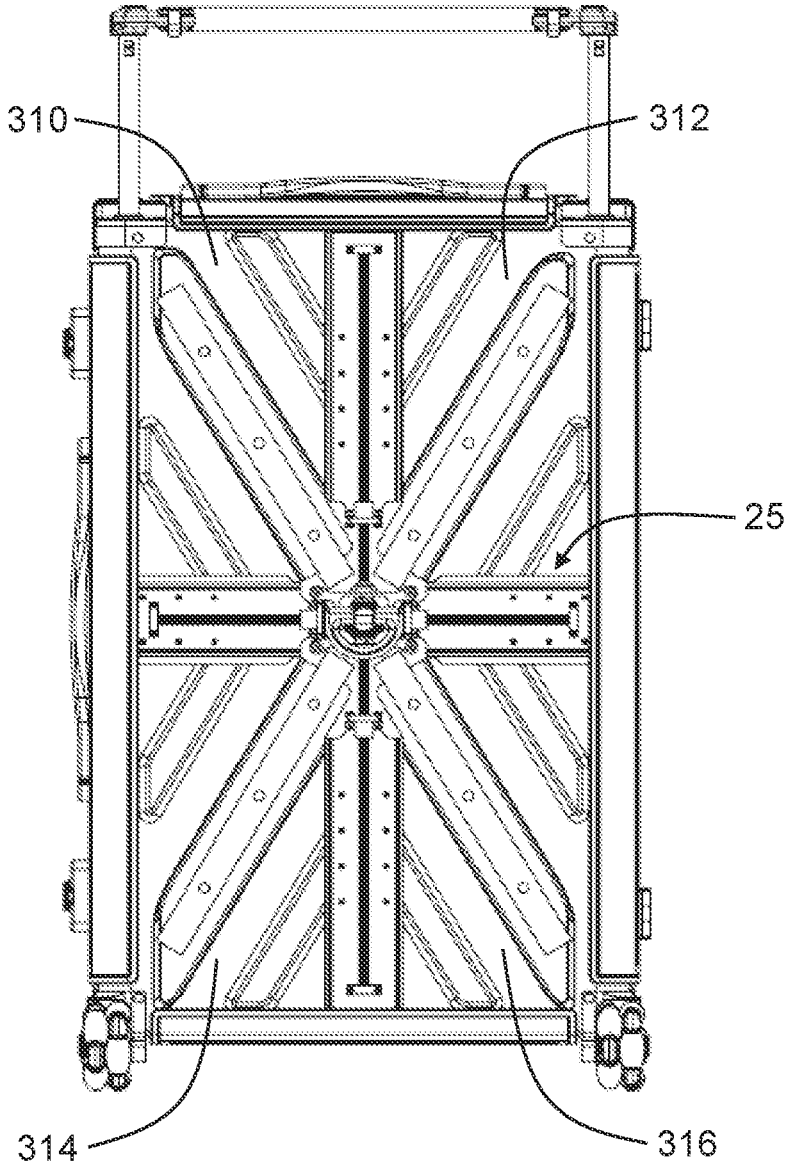
FIG. 4 shows aspects of corner panels of an expandable container according to exemplary embodiments hereof.

In some embodiments, as shown in FIGS. 3-4, the first panel assembly 300 includes a left side panel 302, a right side panel 304, an upper side panel 306, and a lower side panel 308 (see FIG. 3 for side panels 302, 304, 306, 308), and an upper left corner panel 310, an upper right corner panel 312, a lower left corner panel 314, and a lower right corner panel 316 (see FIG. 4 for corner panels 310, 312, 314, 316). As described herein, the side panels 302, 304, 306, 308 and the corner panels 310, 312, 314, 316 are configured with one another and with the back base member 25 to for support and to facilitate each panels' respective movements.

In general, movements of the side panels 302, 304, 306, 308 are caused by use of the first expansion control mechanism 400, and movements of the corner panels 310, 312, 314, 316 are caused by the movement of the side panels 302, 304, 306, 308. Accordingly, movement of the side panels 302, 304, 306, 308 will be described first followed by a description regarding the movement of the corner panels 310, 312, 314, 316.

In some embodiments as shown in FIG. 3, the side panels 302, 304, 306, 308 may each be caused to move outward from a central region of the back side 14 in order to expand the size of the case's back side 14. For example, the left side panel 302 may be caused to move outward in the direction of arrow A, the right side panel 304 may be caused to move outward in the direction of arrow B, the upper side panel 306 may be caused to move outward in the direction of arrow C, and the lower side panel 308 may be caused to move outward in the direction of arrow D. In addition, the side panels 302, 304, 306, 308 may each be subsequently caused to move inward from the expanded positions in order to decrease the size of the case's back side 14.

In some embodiments, the side panels 302, 304, 306, 308 are caused to each move outwards and/or inward as described above by the first expansion control mechanism 400.

Figure 5:
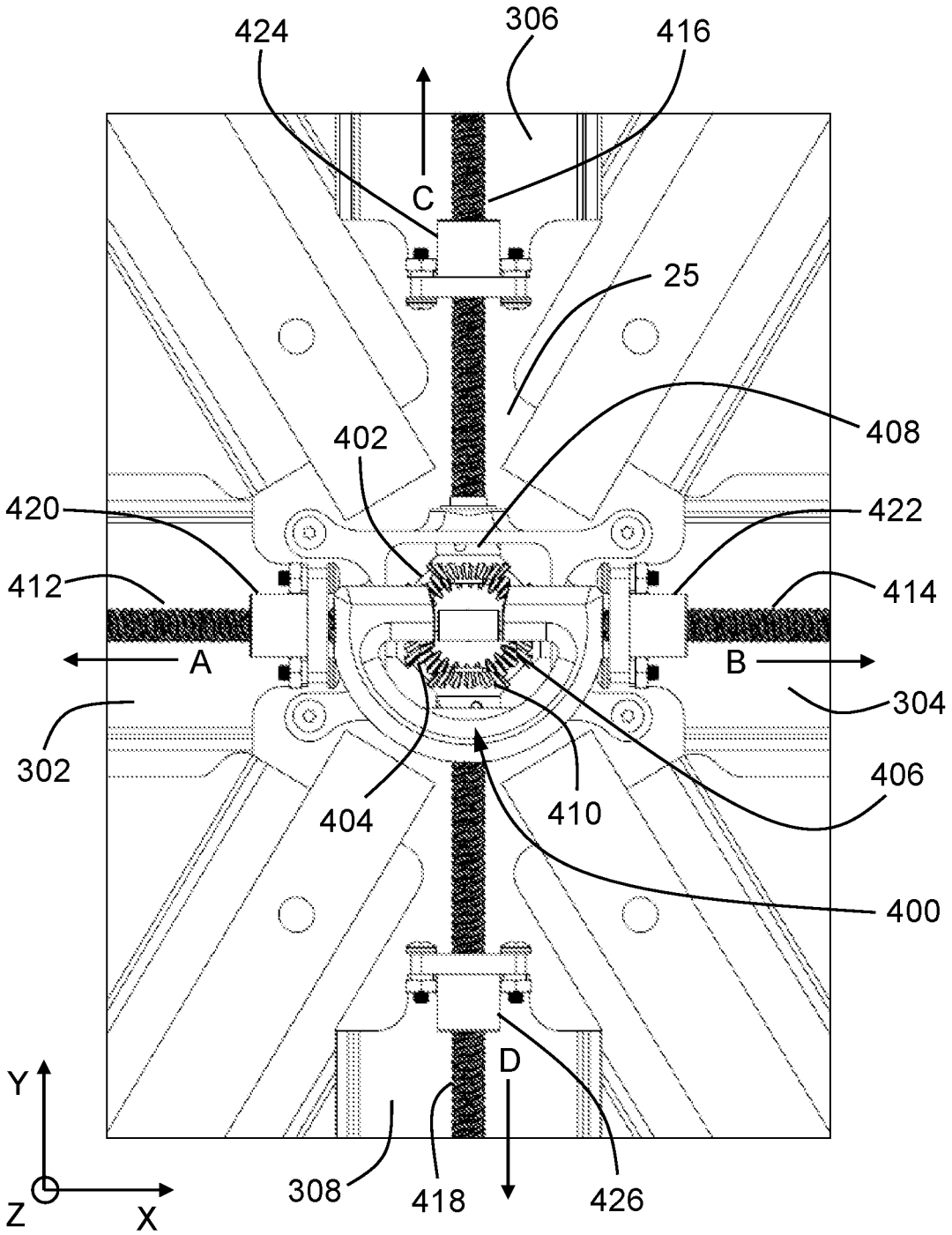
FIGS. 5-6 show aspects of an expansion control mechanism according to exemplary embodiments hereof.

In some embodiments, as shown in FIG. 5, the expansion control mechanism 400 is mounted in the central region of the back base member 25 (e.g., within a gear box) and includes a central gear 402, a left gear 404, a right gear 406, an upper gear 408, and a lower gear 410. In some embodiments, each gear 402, 404, 406, 408, 410 includes a bevel gear (each with a pitch-surface, i.e., a tooth-bearing face, that is conically shaped as is known in the art).

As shown in FIG. 5, the central bevel gear 402 is configured to engage with each of the left bevel gear 404, right bevel gear 406, upper bevel gear 408, and lower bevel gear 410. In general, the rotational axis of the central bevel gear 402 is along the Z-axis, the rotational axis of the left and right bevel gears 404, 406 area along the X-axis, and the rotational axis of the upper and lower bevel gears 408, 410 are along the Y-axis. In this way, the rotational axis of the central bevel gear 402 is perpendicular to the rotational axis of the left, right, upper, and lower bevel gears 404-410. In addition, the left bevel gear 404 generally opposes the right bevel gear 406, and the upper bevel gear 408 generally opposes the lower bevel gear 410. Also, it may be preferable that the rotational axis of the left and right bevel gears 404, 406 be aligned and parallel with one another, and that the rotational axis of the upper and lower bevel gears 408, 410 be aligned and parallel with one another. It also may be preferable that the rotational axis of the left and right bevel gears 404, 406 be generally perpendicular to the rotational axis of the upper and lower bevel gears 408, 410.

With the teeth of the central gear 402 engaged and meshed with the teeth of the left, right, upper, and lower gears 404-410 as shown in FIG. 5, a rotational movement of the central gear 402 about its rotational axis (e.g., about the Z-axis in FIG. 5) causes the left and right gears 404, 406 to each rotate about their rotational axis (e.g., about the X-axis in FIG. 5), and the upper and lower gears 408, 410 to each rotate about their rotational axis (e.g., about the Y-axis in FIG. 5).

In some embodiments, as shown in FIG. 5, the left gear 404 is coupled to the proximal end of a left threaded shaft 412 with the left threaded shaft 412 aligned with and acting as the rotational axis of the left gear 404, the right gear 406 is coupled to the proximal end of a right threaded shaft 414 with the right threaded shaft 414 aligned with and acting as the rotational axis of the right gear 406, the upper gear 408 is coupled to the proximal end of an upper threaded shaft 416 with the upper threaded shaft 416 aligned with and acting as the rotational axis of the upper gear 408, and the lower gear 410 is coupled to the proximal end of a lower threaded shaft 418 with the lower threaded shaft 418 aligned with and acting as the rotational axis of the lower gear 410. The distal ends of threaded shafts 412, 414, 416, 418 are rotatably coupled to bearings 413, 415, 417, 419, respectively, with each bearing 413, 415, 417, 419 coupled to the back base member 25 to provide the necessary support to the shafts 412, 414, 416, 418 (see FIG. 3). In this configuration, as the left, right, upper, and lower gears 404, 406, 408, 410 are caused to rotate by the rotation of the central gear 402, the threaded shafts 412, 414, 416, 418 also are caused to rotate, respectively. Notably, as the central gear 402 is caused to rotate in a first direction (e.g., clockwise), the threaded shafts 412, 414, 416, 418 are each caused to rotate in a direction generally opposite the first direction (e.g., counterclockwise).

In some embodiments, as shown in FIG. 5, the left threaded shaft 412 includes a left threaded slider 420 rotatably coupled and threadedly engaged about its circumference, the right threaded shaft 414 includes a right threaded slider 422 rotatably coupled and threadedly engaged about its circumference, the upper threaded shaft 416 includes an upper threaded slider 424 rotatably coupled and threadedly engaged about its circumference, and the lower threaded shaft 418 includes a lower threaded slider 426 rotatably coupled and threadedly engaged about its circumference.

In some embodiments, as shown in FIGS. 5, the left side panel 302 is coupled to the left threaded slider 420, the right side panel 304 is coupled to the right threaded slider 422, the upper side panel 306 is coupled to the upper threaded slider 424, and the lower side panel 308 is coupled to the lower threaded slider 426. With each threaded slider 420, 422, 424, 426 coupled to its respective side panel 302, 304, 306, 308, the threaded sliders 420, 422, 424, 426 are generally prevented from rotating about their respective threaded shafts 412, 414, 416, 418, and instead, are caused to translate along the longitudinal length of each respective shaft 412, 414, 416, 418 as the shafts 412, 414, 416, 418 are caused to turn. For example, as the left threaded shaft 412 is caused to rotate counterclockwise, the left threaded slider 420 is caused to translate outward along the longitudinal length of the shaft 412, e.g., in the direction of the outward arrow A in FIG. 5. Similarly, as the right, upper, and lower threaded shafts 414, 416, 418 are caused to rotate counterclockwise, each corresponding threaded slider 422, 424, 426 is caused to translate outward along the longitudinal length of its respective threaded shaft 414, 416, 418, e.g., in the directions of outward arrows B, C, and D in FIG. 5, respectively.

Figure 6:
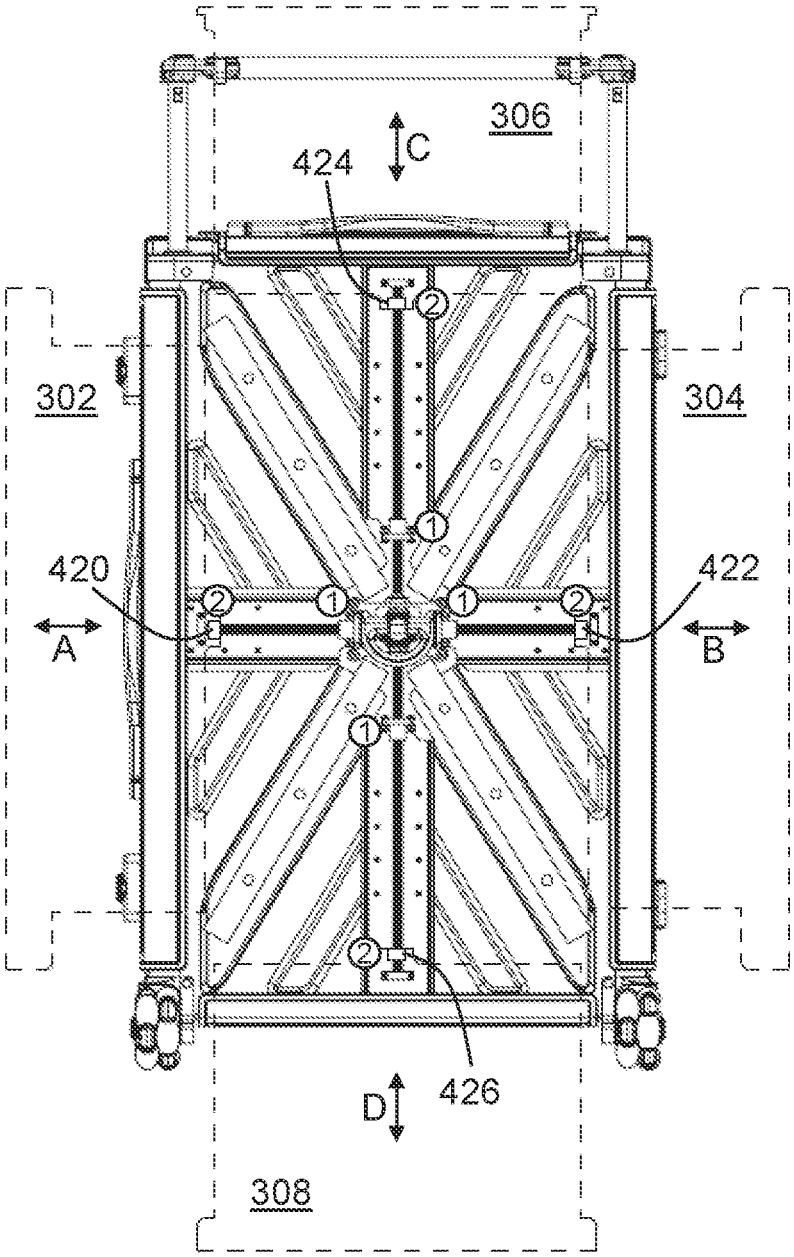

In the configuration described above, and as shown in FIG. 6, as the left threaded slider 420 is caused to move to the left from its position 1 to its position 2, the left side panel 302 also is caused to move to the left in the direction of outward arrow A. Similarly, as the right threaded slider 422 is caused to move to the right from its position 1 to its position 2, the right side panel 304 is caused to move to the right in the direction of outward arrow B, as the upper threaded slider 424 is caused to move upwards from its position 1 to its position 2, the upper side panel 306 also is caused to move upward in the direction of outward arrow C, and as the lower threaded slider 426 is caused to move downward from its position 1 to its position 2, the lower side panel 308 also is caused to move downward in the direction of outward arrow D.

Conversely, as each of the threaded shafts 412-418 are caused to rotate in a direction opposite the direction described in the above examples, e.g., clockwise, each of the threaded sliders 420-428 are caused to translate along their respective threaded shafts 412-418 in an opposite direction, e.g., in the direction of the inward arrows A, B, C, D, respectively.

Given the above, it can be seen that by causing the central gear 402 to rotate in a clockwise direction, the panels 302, 304, 306, 308 are each caused to move outwards (thereby increasing the size of the back side 14), and as the central gear 402 is caused to rotate in a counterclockwise direction, the panels 302, 304, 306, 308 are each caused to move inwards (thereby reducing the size of the back side 14). It is understood that the components within the first expansion control mechanism 400 may be configured for the elements to move in other directions. It also is understood that the expansion control mechanism 400 may include any mechanism that translates rotational movement (e.g., of the central gear 402) into linear movement (e.g., of the side panels 302, 304, 306, 308), e.g., a rack and pinion assembly. That is, the control mechanism 400 may include any type of rotational movement to linear movement translation mechanism.

Figure 7:
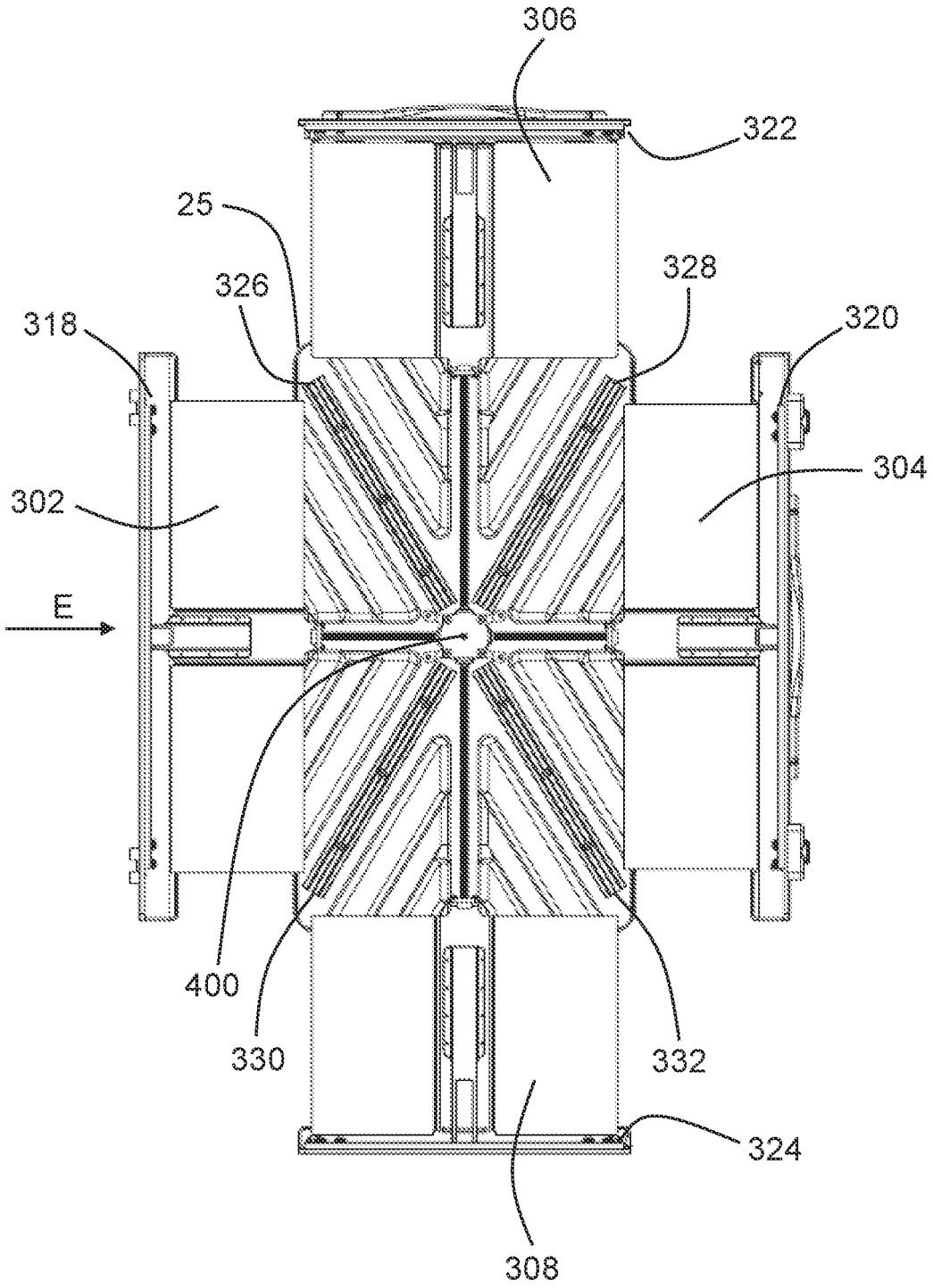
FIGS. 7-8 show aspects of side panels of an expandable container according to exemplary embodiments hereof.
Figure 8:
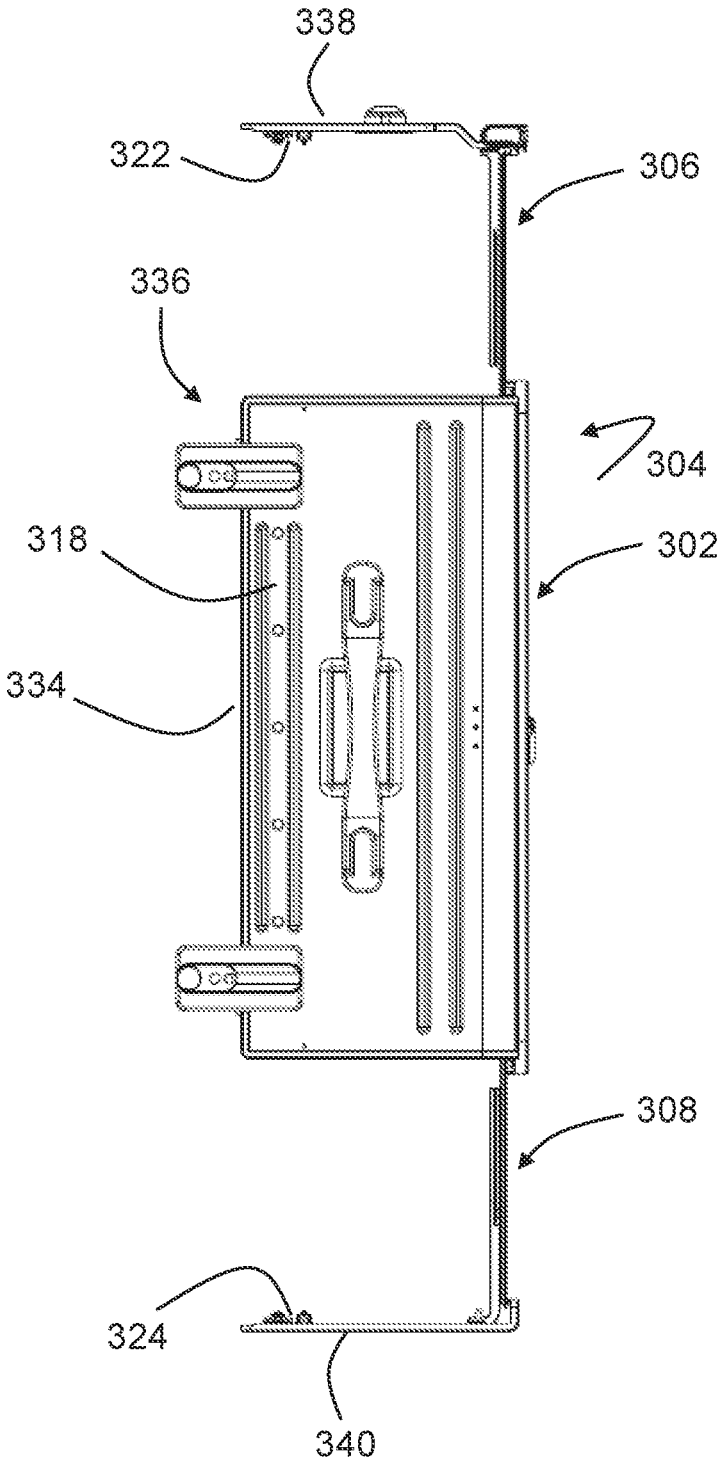

FIG. 7 shows the side panels 302, 304, 306, 308 configured with the inner side (the side facing the inner volume V1) of the base member 25 and the expansion control mechanism 400 as described herein. As shown, the panels 302, 304, 306, 308 are in an expanded configuration (having been caused to move outwards). FIG. 8 shows the embodiment of FIG. 7 taken from the perspective of the arrow E of FIG. 7.

In some embodiments, as shown in FIG. 7, the left side panel 302 includes a left side guide rail 318 running generally vertically along its outer distal side, the right side panel 304 includes a right side guide rail 320 running generally vertically along its outer distal side, the upper side panel 306 includes an upper side guide rail 322 running generally horizontally along its outer distal side, and the lower side panel 308 incudes a lower side guide rail 324 running generally horizontally along its outer distal side. Also shown in FIG. 7 is a first diagonal guide rail 326 coupled to the base member 25 and extending from a central region of the base member 25 to an upper left corner region of the base member 25, a second diagonal guide rail 328 coupled to the base member 25 and extending from a central region of the base member 25 to an upper right corner region of the base member 25, a third diagonal guide rail 330 coupled to the base member 25 and extending from a central region of the base member 25 to an lower left corner region of the base member 25, and a fourth diagonal guide rail 332 coupled to the base member 25 and extending from a central region of the base member 25 to an lower right corner region of the base member 25. As will be described in other sections, the guide rails 318, 320, 322, 324, 326, 328, 330, 332 facilitate movement of the corner panels 310, 312, 314, 316 upon movement of the side panels 302, 304, 306, 308.

In some embodiments, each of the side panels 302, 304, 306, 308 include portions that extend over the sides 18, 20, 22, 24, respectively, of the case body 12. For example, as shown in FIG. 8, the left side panel 302 includes a left side portion 334 that extends over at least a portion of the assembly's left side 18, the right side panel 304 includes a right side portion 336 (behind and obstructed from view by the left side portion 334 in FIG. 8) that extends over at least a portion of the assembly's right side 20, the upper side panel 306 includes an upper side portion 338 that extends over at least a portion of the assembly's upper side 22, and the lower side panel 308 includes a lower side portion 340 that extends over at least a portion of the assembly's lower side 24. In this way, as the panels 302, 304, 306, 308 are caused to move outwards thereby expanding the back side 14 of the expandable case 12, the associated portions 334, 336, 338, 340, respectively, of the left side 18, right side 20, top side 22, and bottom side 24 also move outward thereby expanding the inner volume V1.

In some embodiments, as shown in FIG. 8, the left side guide rail 318 is coupled to the left side portion 334, the right side guide rail 320 is coupled to the right side portion 336, the upper side guide rail 322 is coupled to the upper side portion 338, and the lower side guide rail 324 is coupled to the lower side portion 340. However, it is understood that the guide rails 318, 320, 322, 324 may be couple in any position on their respective panels 302, 304, 306, 308, respectively, as required.

As described next, movement of the corner panels 310, 312, 314, 316 is caused by the movement of the side panels 302, 304, 306, 308 via the guide rails.

Figure 9:
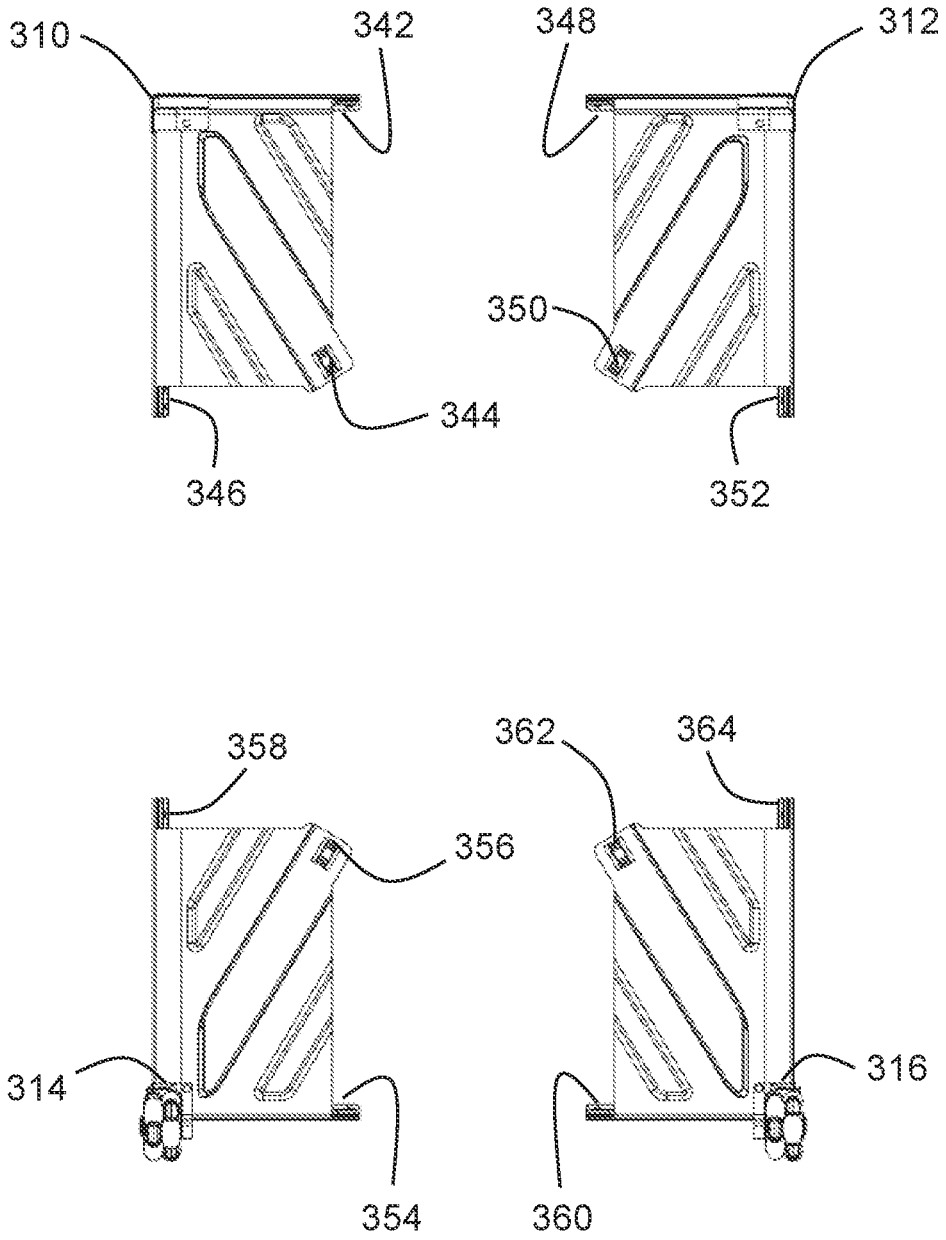
FIGS. 9-10 show aspects of corner panels of an expandable container according to exemplary embodiments hereof.

In some embodiments, as shown in FIG. 9, the upper left corner panel 310 includes an upper left first slider 342 adapted to slidably engage the upper side panel's upper guide rail 322 (e.g., the left portion of the guide rail 322), an upper left second slider 344 adapted to slidably engage the base member's first diagonal guide rail 326, and an upper left third slider 346 adapted to slidably engage the left side panel's left side guide rail 318 (e.g., the upper portion of the guide rail 318).

Similarly, the upper right corner panel 312 includes an upper right first slider 348 adapted to slidably engage the upper side panel's upper guide rail 322 (e.g., the right portion of the guide rail 322), an upper right second slider 350 adapted to slidably engage the base member's second diagonal guide rail 328, and an upper right third slider 352 adapted to slidably engage the right side panel's right side guide rail 320 (e.g., the upper portion of the guide rail 320).

Similarly, the lower left corner panel 314 includes a lower left first slider 354 adapted to slidably engage the lower side panel's lower guide rail 324 (e.g., the left portion of the guide rail 324), a lower left second slider 356 adapted to slidably engage the base member's third diagonal guide rail 330, and a lower left third slider 358 adapted to slidably engage the left side panel's left side guide rail 318 (e.g., the lower portion of the guide rail 318).

Similarly, the lower right corner panel 316 includes a lower right first slider 360 adapted to slidably engage the lower side panel's lower guide rail 324 (e.g., the right portion of the guide rail 324), a lower left second slider 362 adapted to slidably engage the base member's fourth diagonal guide rail 332, and a lower left third slider 364 adapted to slidably engage the right side panel's right side guide rail 320 (e.g., the lower portion of the guide rail 320).

Figure 10:
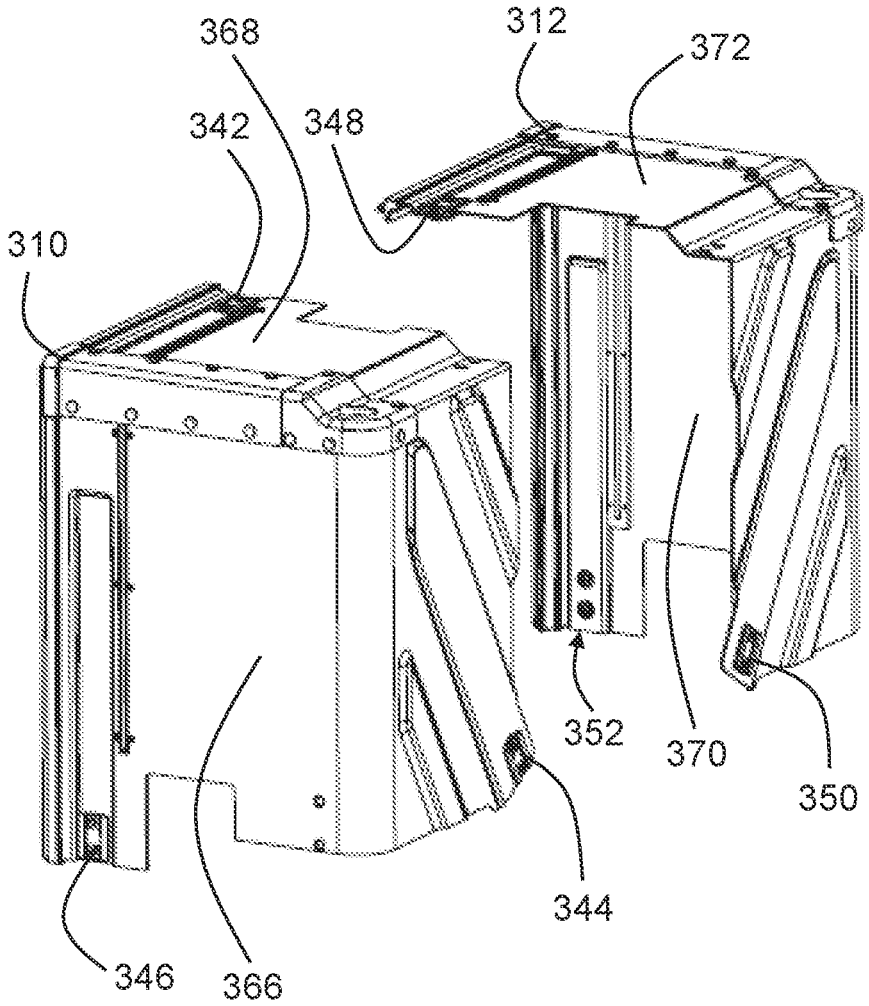

For additional clarity, FIG. 10 shows a schematic of the upper left corner panel 310 including the upper left first slider 342, the upper left second slider 344 and the upper left third slider 346, and the upper right corner panel 312 including the upper right first slider 348, the upper right second slider 344, and the upper right third slider 346.

FIG. 10 also depicts portions of the corner panels 310, 312, 314, 316 that may be adapted to extend over the sides 18, 20, 22, 24 of the case body 12.

For example, in some embodiments, as shown in FIG. 10, the upper left corner panel 310 includes an upper left side portion 366 that extends over at least a portion of the assembly's left side 18, and an upper left top side portion 368 that extends over at least a portion of the assembly's top upper side 22. Similarly, the upper right corner panel 312 includes an upper right side portion 370 that extends over at least a portion of the assembly's right side 20, and an upper right top side portion 372 that extends over at least a portion of the assembly's top upper side 22. Similarly, and although not shown, the lower left corner panel 314 includes a lower left side portion 374 that extends over at least a portion of the assembly's left side 18, and an lower left bottom side portion 376 that extends over at least a portion of the assembly's bottom lower side 24, and the lower right corner panel 316 includes an lower right side portion 378 that extends over at least a portion of the assembly's right side 20, and a lower right bottom side portion 380 that extends over at least a portion of the assembly's bottom lower side 24. In this way, as the panels 310, 312, 314, 316 are caused to move outwards thereby expanding the back side 14 of the expandable case 12, the associated portions 366, 368, 370, 372, 374, 376, 378, 380, respectively, of the left side 18, right side 20, top side 22, and bottom side 24 also move outward thereby expanding the inner volume V1.

In some embodiments, the corner panel sliders are configured with the portions of the corner panels 310, 312, 314, 316 that may extend over the sides 18, 20, 22, 24 as described above. For example, as shown in FIG. 10, the upper left corner panel's 310's upper left first slider 342 is configured with the upper left top side portion 368, the upper left corner panel's 310's upper left third slider 346 is configured with the upper left side portion 366, the upper right corner panel's 312's upper right first slider 348 is configured with the upper right top side portion 372, and the upper right corner panel's 312's upper right third slider 352 is configured with the upper right side portion 370. Similar configurations including the lower left and lower right sets of sliders in relation to the lower left and right corner panels 314, 316 also may be utilized.

In some embodiments, movement of the side panels 302, 304, 306, 308 causes movement of the associated guide rails causing movement of each respective slider within each respective guide rail thereby causing movement of the corner panels 310, 312, 314, 316.

Figure 11:
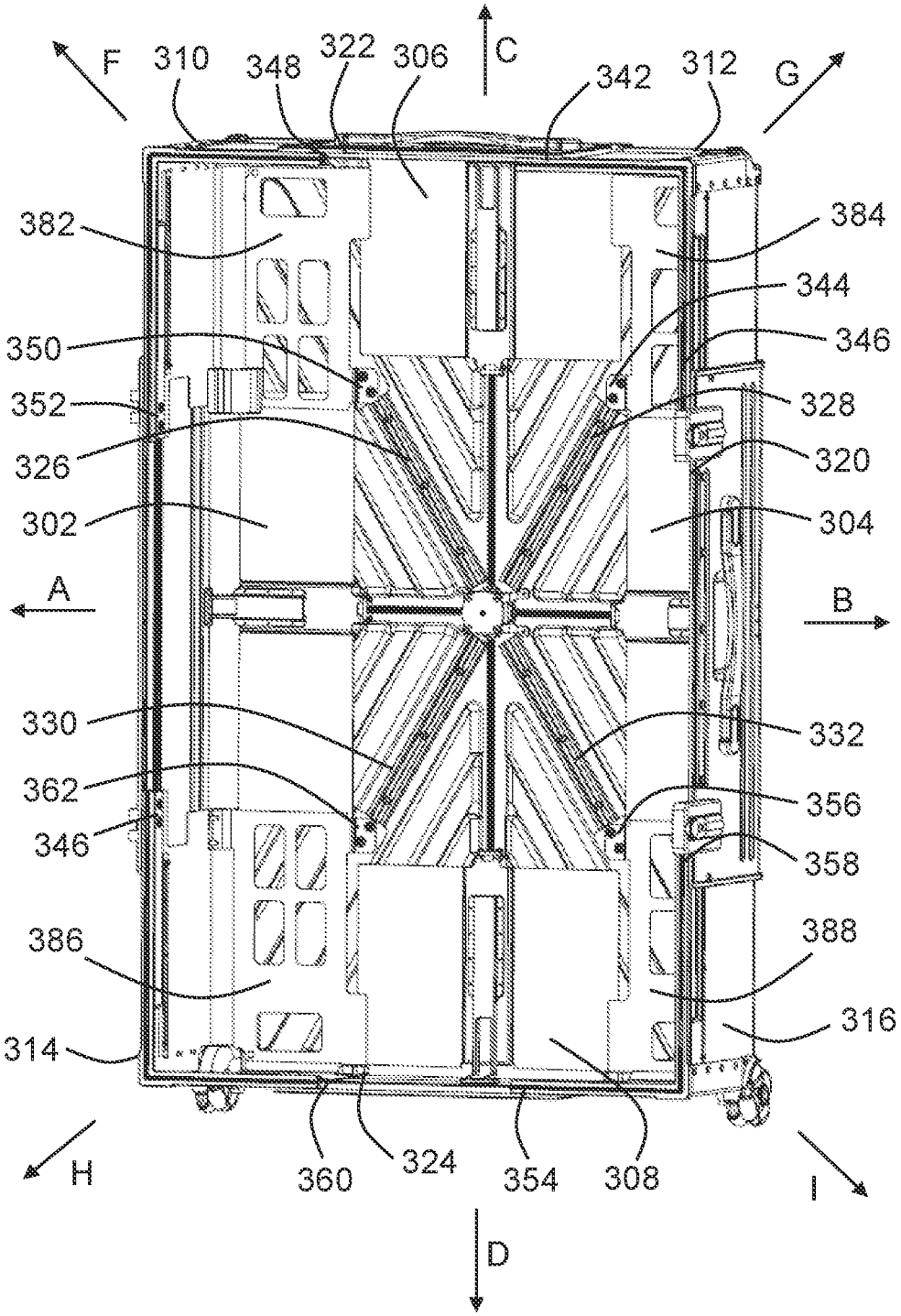
FIGS. 11-13 show aspects of side panels and corner panels at different placements according to exemplary embodiments hereof.
Figure 12:
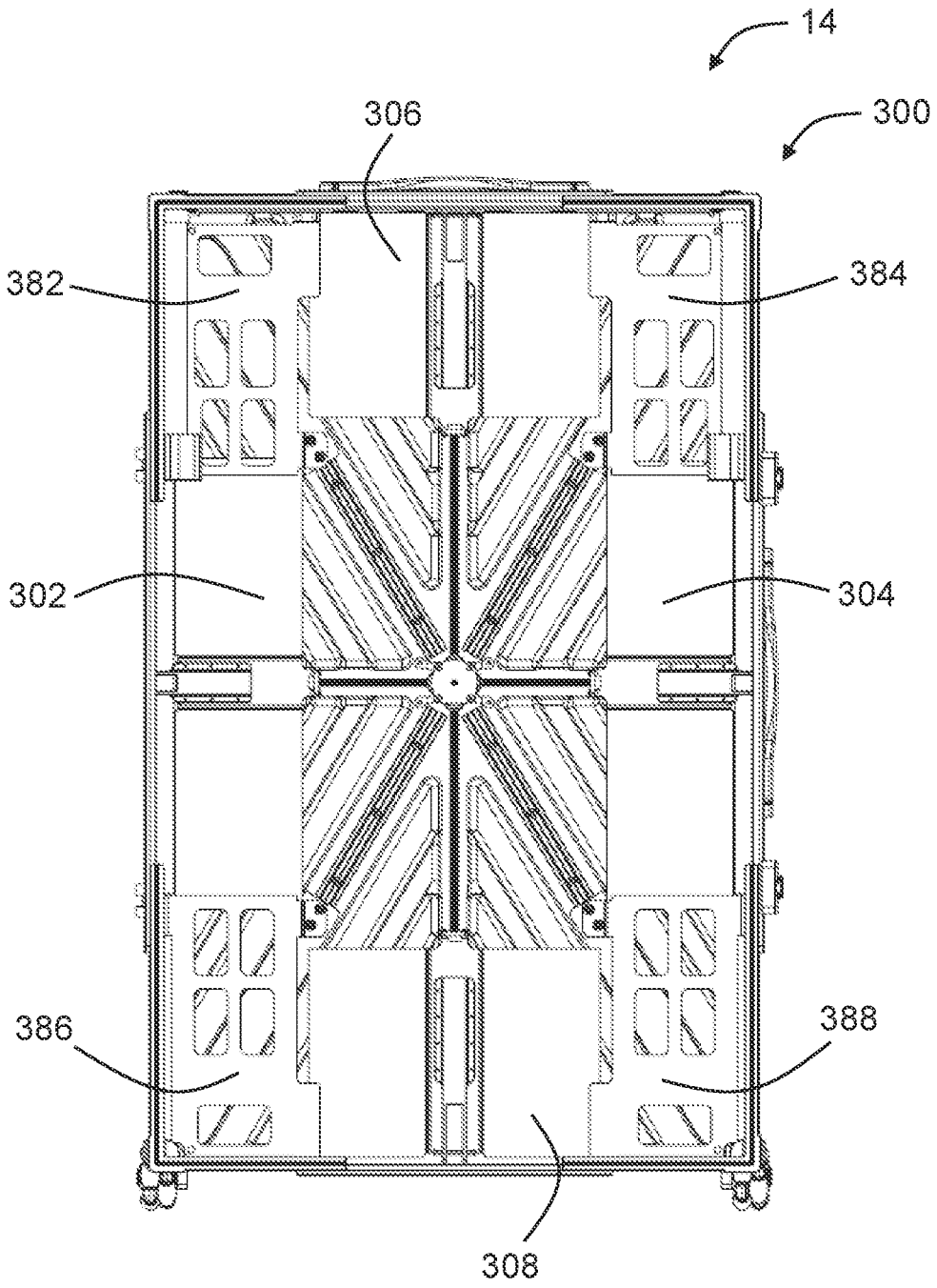
Figure 13:
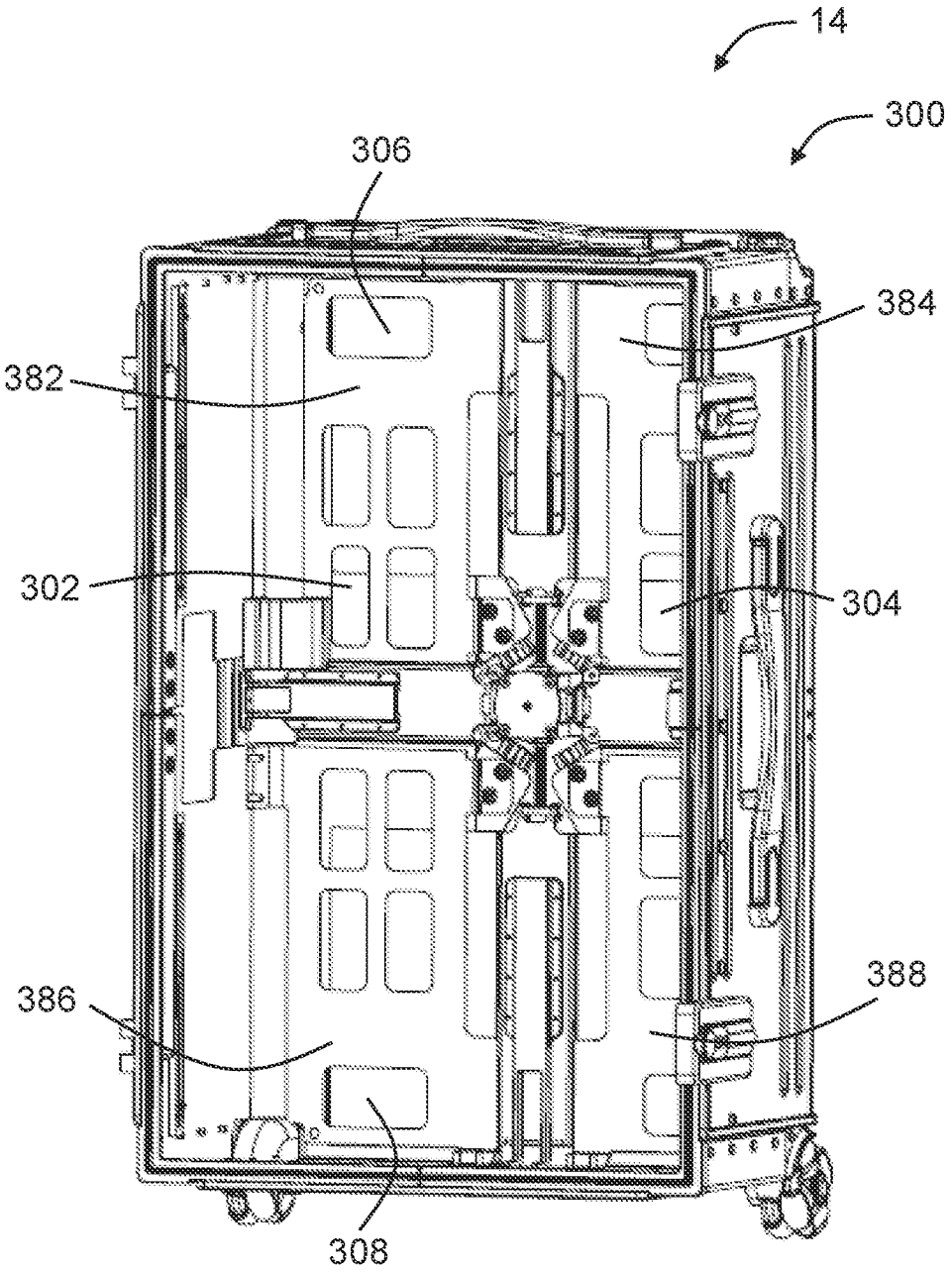

FIG. 11 shows the back side 14 of the expandable case 12 in a partially expanded state (not fully expanded and not fully retracted), FIG. 12 shows the back side 14 in a fully expanded state, and FIG. 13 shows the back side 14 in a fully retracted state.

In some embodiments, as shown in FIGS. 11-12, the back side 14 includes an upper left inner support plate 382 coupled to and parallel with the inner back side of the upper left corner panel 310 and connected to the upper left corner panel slider 350 (e.g., within the inner portion of the case 12). In some embodiments, a gap exists between the upper left inner support plate 382 and the inner back side of the upper left corner panel 310 that is designed to receive portions of the left side panel 302 and/or portions of the upper side panel 306 as the panels 302, 306 move inward and outward to expand and retract the case 10 as described herein. The upper left inner support plate 382 and the gap that it forms with the upper left corner panel 310 thereby provides a support and guiding structure to the side plates 302, 306 during movement of the side plates 302, 306.

Similarly, the back side 14 also includes an upper right inner support plate 384 coupled to the upper right corner panel 312 (forming a gap therebetween) and to the upper left corner panel slider 344, a lower left inner support plate 386 coupled to the lower left corner panel 314 (forming a gap therebetween) and to the lower left corner panel slider 362, and a lower right inner support plate 388 coupled to the lower right corner panel 316 (forming a gap therebetween) and to the lower right corner panel slider 356 (e.g., all within the inner portion of the case 12). The support plates 384, 386, 388 and the gaps formed with their respective corner panels 312, 314, 316 provide support and guiding structure to the respective side panels 306, 304, 308, 302 during the motion of the side panels 306, 304, 308, 302 during the expansion and retraction of the case 10.

Notably, FIG. 12 shows the back side 14 expanded with small portions of the side panels 302, 304, 306, 308 within the gaps behind their respective support panels 382, 384, 386, 388 while FIG. 13 shows the back side 14 retracted with the side panels 302, 304, 306, 308 almost entirely within the gaps behind their respective support panels 382, 384, 386, 388 for support.

In some embodiments, as shown in FIG. 11, as a first force is applied by the expansion control mechanism 400 to the side panel 302 in the direction of the arrow A and a second force is applied by the expansion mechanism 400 to the side panel 306 in the second direction of the arrow C, the first and second forces add vectorially resulting in a third force that causes the corner panel 310 to move in the direction of the arrow. As a fourth force is applied by the expansion mechanism 400 to the side panel 304 in the fourth direction of the arrow B and a fifth force is applied by the expansion mechanism 400 to the side panel 306 in the second direction of the arrow C, the fourth and fifth forces add vectorially resulting in a sixth force that causes the corner panel 312 to move in the sixth direction of the arrow G. As the first force is applied by the expansion mechanism 400 to the side panel 302 in the first direction of the arrow A and a seventh force is applied by the expansion mechanism 400 to the side panel 308 in the seventh direction of the arrow D, the first and seventh forces add vectorially resulting in an eighth force that causes the corner panel 314 to move in the ninth direction of the arrow H. As the fourth force is applied by the expansion mechanism 400 to the side panel 304 in the fourth direction of the arrow B and seventh force is applied by the expansion mechanism 400 to the side panel 308 in the seventh direction of the arrow D, the fourth and seventh forces add vectorially resulting in an eighth force that causes the corner panel 316 to move in the eighth direction of the arrow I. This may result in the fully extended configuration shown in FIG. 12.

For example, as the left side panel 302 is caused to move in the direction of the arrow A and the top side panel 306 is caused to move in the direction of the arrow C, the upper left corner panel slider 348 moves to the direction of the arrow A within the guide rail 322, the upper left corner panel slider 352 moves in the direction of the arrow C within the guide rail 318, and the upper left corner panel slider 350 moves in the direction of the arrow F within the guide rail 326. Similarly, as the right side panel 304 is caused to move in the direction the arrow B and the top side panel 306 is caused to move in the direction of the arrow C, the upper right corner panel slider 342 moves in the direction of the arrow B within the guide rail 322, the upper right corner panel slider 352 moves in the direction of the arrow C within the guide rail 320, and the upper right corner panel slider 344 moves in the direction of the arrow G within the guide rail 328. Similarly, as the left side panel 302 is caused to move in the direction of the arrow C and the bottom side panel 308 is caused to move in the direction of the arrow D, the lower left corner panel slider 364 is caused to move in the direction of the arrow D within the guide rail 318, the lower left corner slider 360 is caused to move in the direction of the arrow A within the guide rail 324, and the lower left corner panel slider 362 is caused to move in the direction of the arrow H within the guide rail 330. Similarly, as the right side panel 304 is caused to move in the direction of the arrow B and the bottom side panel 308 is caused to move in the direction of the arrow D, the lower right panel slider 358 is caused to move in the direction of the arrow D within the guide rail 320, the lower right panel slider 354 is caused to move in the direction of the arrow B within the guide rail 324, and the lower right corner panel slider 356 is caused to move in the direction of the arrow I within the guide rail 332.

Alternatively, forces applied by the expansion control mechanism 400 to the side panels 302, 304, 306, 308 of FIG. 11 in the generally opposite directions of the arrows A, B, C, D, respectively, may then cause the corner panels 310, 312, 314, 316 to generally move in the directions opposite of the arrows F, G, H, I, respectively, with the various sliders moving within the associated guide rails in the opposite directions as described above to decrease the size of the assembly 10. This may result in the fully retracted configuration shown in FIG. 13.

As described herein thus far, the back 14 of the case 12 generally comprises the first panel assembly 300 configured with the first expansion control mechanism 400, each configured with the back base member 25.

Figure 14:
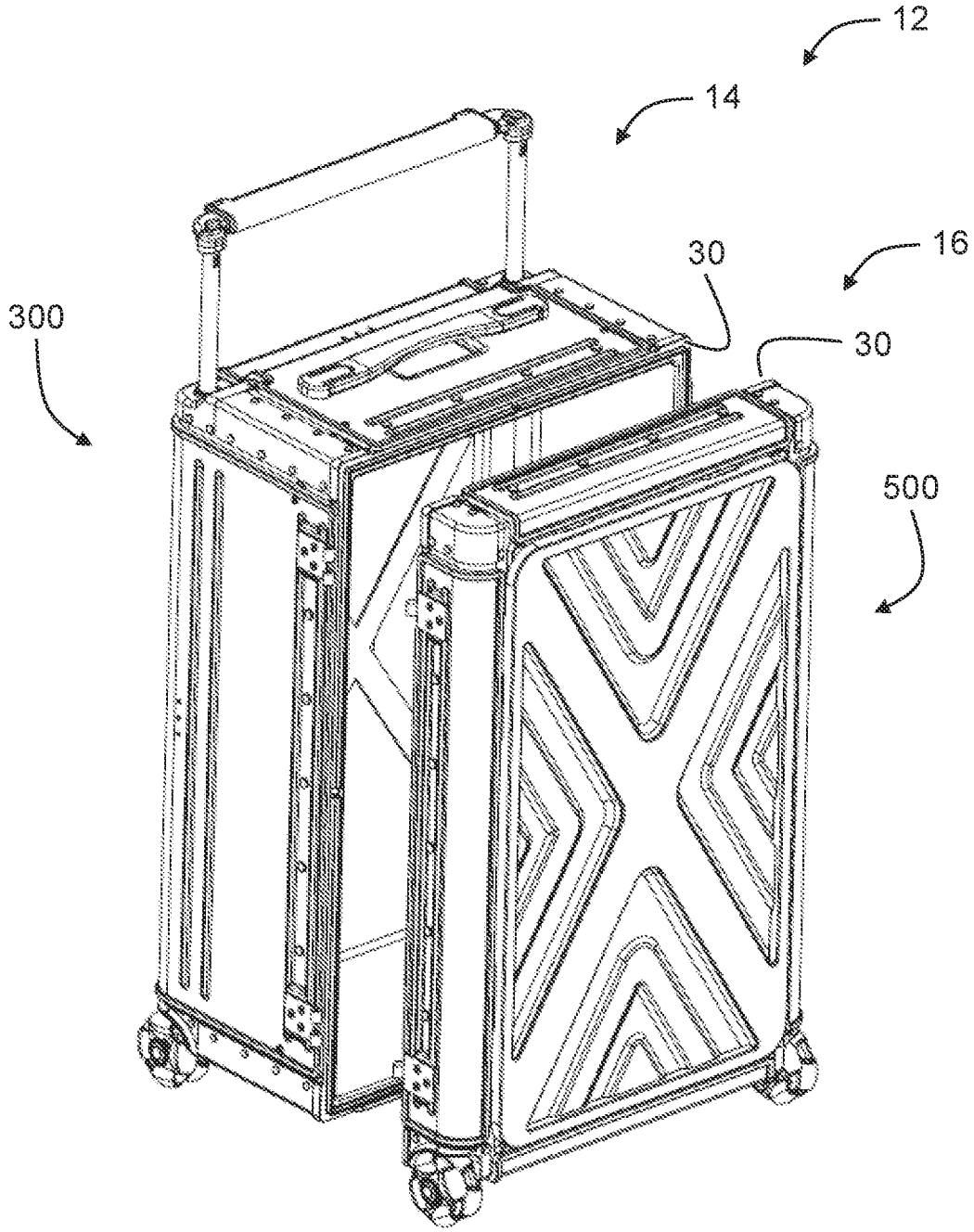
FIGS. 14-16 show aspects of an expandable container according to exemplary embodiments hereof.

In some embodiments, as shown in FIG. 14, the case 12 also includes a second panel assembly 500 configured with a base member. With the second panel assembly 500 configured with the first panel assembly 300, the case 12 is generally formed. Notably, the interface between the first panel assembly 300 and the second panel assembly 500 may define the interface at which the case 12 may be opened and/or closed during use.

In some embodiments, the second panel assembly 500 corresponds to the first panel assembly 300 in that it may include corresponding side panels and corresponding corner panels configured to move outward to expand the inner volume V1 and/or to move inward to decrease the inner volume V1. Accordingly, all (or at least some) of the details regarding the first panel assembly 300 as described herein also may apply to the second panel assembly 500. Given this, and to avoid duplicity, the corresponding side panels, and corresponding corner panels of the second panel assembly 500 will not be described in detail.

In some embodiments, movement of the side panels 302, 304, 306, 308 and the corner panels 310, 312, 314, 316 of the back side 14 as described herein causes similar movement of corresponding side panels and corner panels of the second panel assembly 500 on the front side 16. That is, as the side panels 302, 304, 306, 308 and the corner panels 310, 312, 314, 316 of the back side 14 are moved outward to expand the case's inner volume V1, corresponding side panels and corner panels of the front side 16 also are moved outward to expand the inner volume V1, and as the side panels 302, 304, 306, 308 and the corner panels 310, 312, 314, 316 of the back side 14 are moved inward to decrease the inner volume V1, corresponding side panels and corner panels of the front side 16 also are moved inward to decrease the inner volume V1.

In some embodiments, the side panels 302, 304, 306, 308 and the corner panels 310, 312, 314, 316 of the first panel assembly 300 of the back side 14 are physically engaged with corresponding side panels and corner panels of the second panel assembly 500 on the front side 16. In this way, the side panels 302, 304, 306, 308 and the corner panels 310, 312, 314, 316 of the back side 14 directly apply physical forces to the corresponding side panels and corner panels of the second panel assembly 500 on the front side 16 thereby causing the panels 302, 304, 306, 308, 310, 312, 314, 316 to move.

Figure 15:
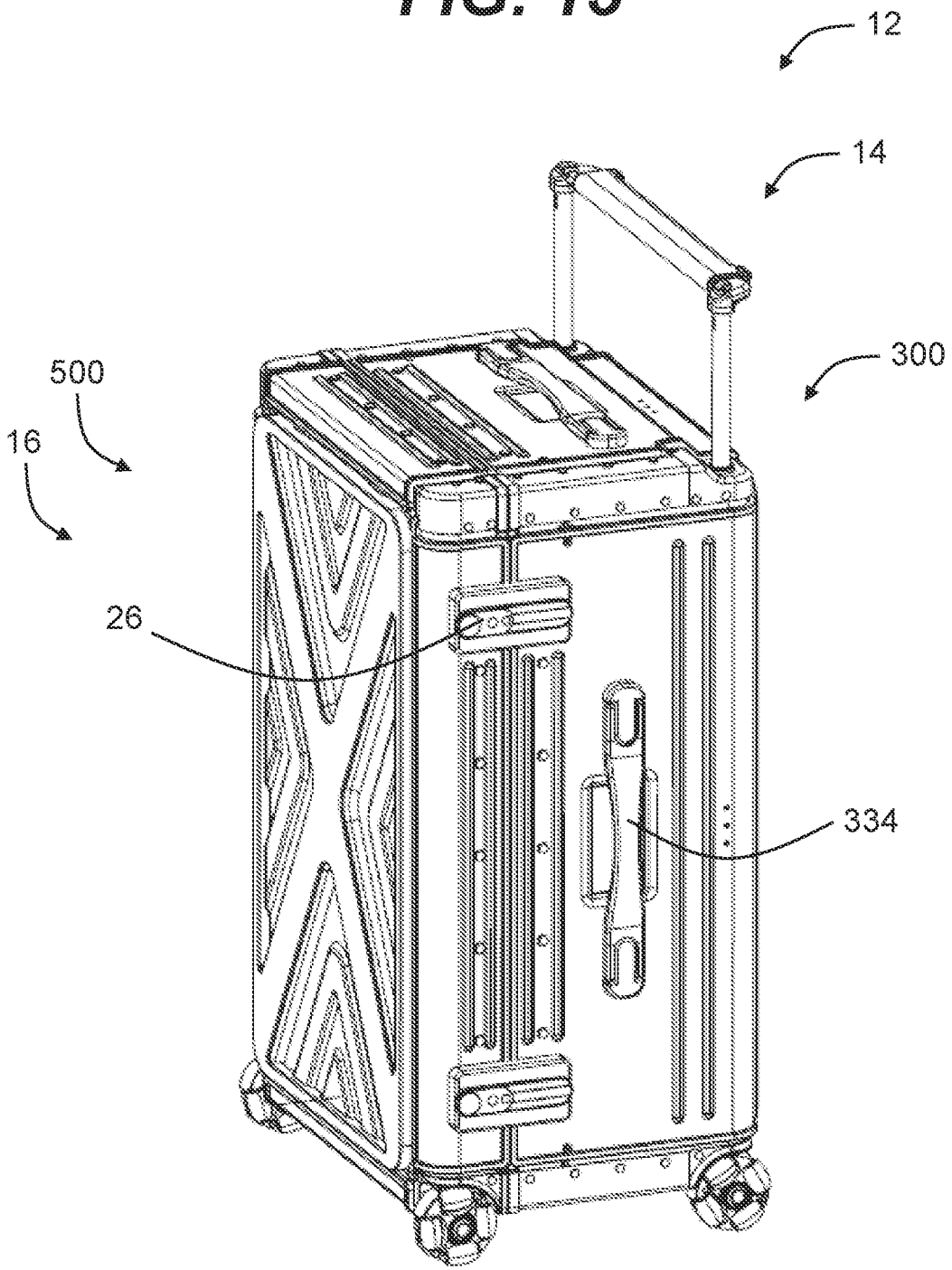

For example, in some embodiments, as shown in FIG. 15, the left side portion 334 of the first panel assembly 300 is physically coupled to a corresponding side portion of the second panel assembly 500 via one or more lock mechanisms 26. The lock mechanisms 26 are generally configured to lock (and/or unlock) the interface between the back 14 portion of the case 12 and the front portion 16 of the case 12 in order to lock the case 12 closed. Accordingly, with the left side portion 334 of the first panel assembly 300 and a corresponding side portion of the second panel assembly 500 coupled together via the locks 26, movement of the left side portion 334 applies a corresponding force to the corresponding side portion on the front side 16 thereby causing it to move in the same direction (inward and/or outward depending on the caused movement).

Figure 16:
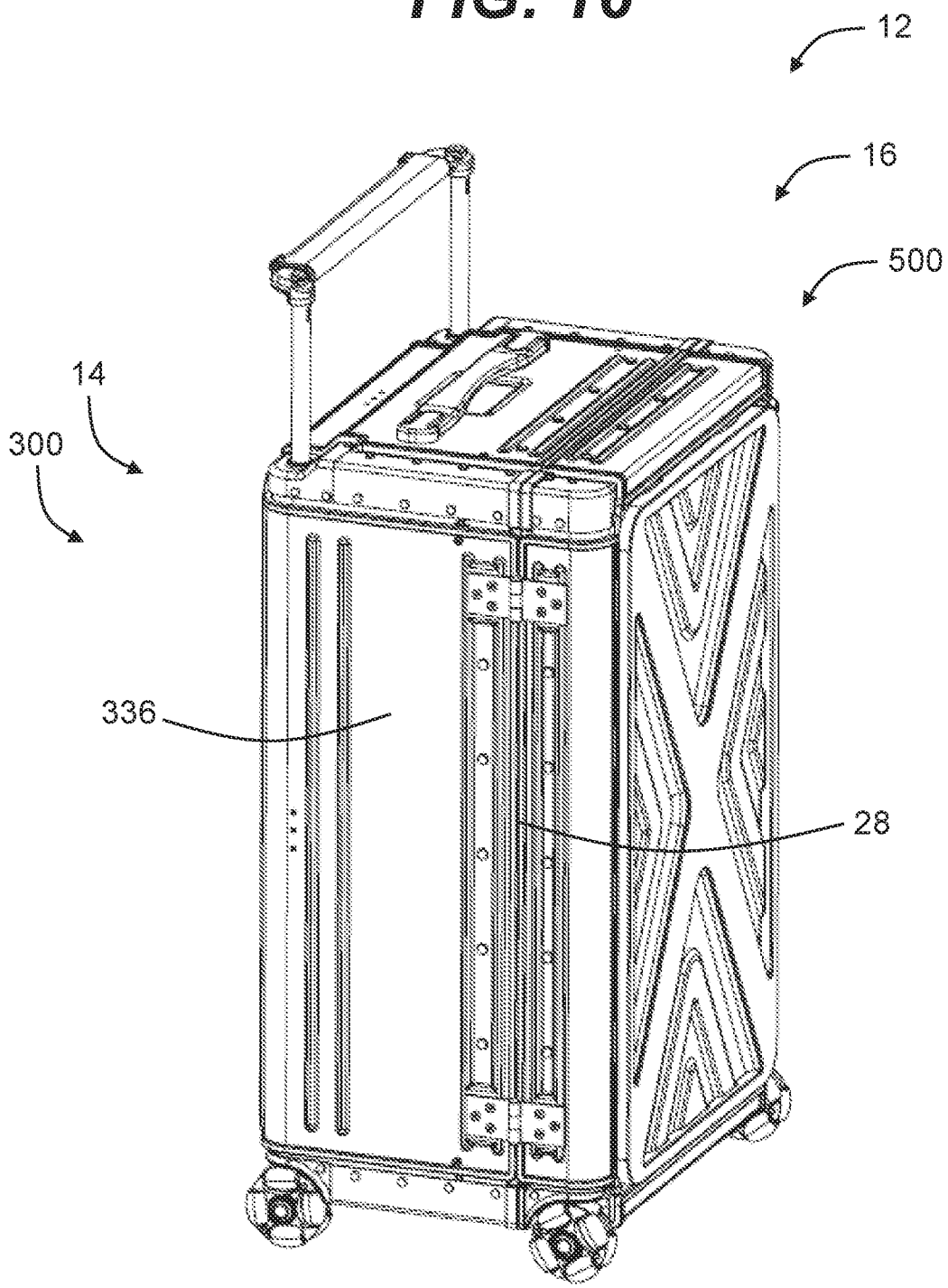

In some embodiments, as shown in FIG. 16, the right side portion 336 of the first panel assembly 300 is physically coupled to a corresponding side portion of the second panel assembly 500 via one or more hinge mechanisms 28. The hinge mechanisms 28 are generally configured to enable the front portion 16 of the case 12 to rotate outward from the back portion 14 of the case 12 when the case 12 is opened during use. Accordingly, with the right side portion 336 of the first panel assembly 300 and a corresponding side portion of the second panel assembly 500 coupled together via the hinge 28, movement of the right side portion 336 applies a corresponding force to the corresponding side portion on the front side 16 thereby causing it to move in the same direction (inward and/or outward depending on the caused movement).

Returning to FIG. 14, in some embodiments, the first and second panel assemblies 300, 500 include a coupling mechanism 30 coupled between the two panel assemblies 300, 500 and configured to releasably couple the two panel assemblies 300, 500 together when the case 12 is closed. In this way, forces applied to the first panel assembly 300 (e.g., via the control mechanism 400) also are applied to the second panel assembly 500 via the coupling mechanism 30.

For example, in some embodiments, the coupling mechanism 30 may extend about the periphery (or at least a portion thereof) of the interface between the first and second panel assemblies 300, 500. In some embodiments, the coupling mechanism 30 may include a lip on one side (e.g., extending about the edge periphery of the first panel assembly 300) that engages with a notch on an opposing side (e.g., extending about the edge periphery of the second panel assembly 500 side). In this way, with the case 12 closed and the notch and lip physically engaged, forces applied to the first panel assembly 300 also may be applied to the second panel assembly 500 via the coupling mechanism 30 (the lip-notch interface). It is understood that other types of coupling mechanisms 30 also may be used such as, without limitation, pins and receiving holes, detents, snaps, etc.

It is understood that any aspect and/or element of any embodiment of the assembly 10 may be combined with any other aspect and/or element of any other embodiment to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. An expandable container apparatus comprising:

a container including an interior back wall including an uppermost edge, a lowermost edge opposite the uppermost edge, a far-left edge, and a far-right edge opposite the far-left edge, and a wall surface extending within a first plane between the uppermost edge, the lowermost edge, the far-left edge, and the far-right edge;

a first guide rail coupled to the wall surface and extending parallel to the first plane from first interior position on the wall surface towards an intersection of the far-left edge and the uppermost edge;

a first slider configured to move along the first guide rail parallel to the first plane;

a first corner panel coupled to the first slider;

a first side panel coupled to the first corner panel and configured with the interior back wall to move horizontally relative to the interior back wall in a first direction that is parallel to the first plane to exert a first force parallel to the first plane and in the first direction to the first slider;

a second side panel coupled to the first corner panel and configured with the interior back wall to move vertically relative to the interior back wall in a second direction that is parallel to the first plane to exert a second force parallel to the first plane and in the second direction to the first slider, the first side panel configured to move in the first direction and the second side panel configured to move in the second direction simultaneously;

an expansion control mechanism configured with the first side panel to move the first side panel horizontally relative to the interior back wall in the first direction and with the second side panel to simultaneously move the second side panel vertically relative to the interior back wall in the second direction;

wherein simultaneous movement of the first side panel in the first direction and the second side panel in the second direction causes the first force and the second force to combine resulting in a third force applied to the first slider in a third direction;

wherein the third force when applied to the first slider causes the first slider and the first corner panel to move along the first guide rail;

wherein the interior back wall, the first side panel, the second side panel, and the first corner panel define a first inner volume of the container;

wherein movement of the first side panel in the first direction and movement of the second side panel in the second direction and movement of the first corner panel along the first guide rail causes the first inner volume of the container to expand;

wherein the first side panel includes a first side panel guide rail, and the first corner panel includes a third slider configured to move along the first side panel guide rail during movement of the first corner panel along the first guide rail.

2. The apparatus of claim 1 wherein the expansion control mechanism includes a rotational movement to linear movement translation mechanism.

3. The apparatus of claim 1 wherein the second side panel includes a second side panel guide rail, and the first corner panel includes a fourth slider configured to move along the second side panel guide rail during movement of the first corner panel along the first guide rail.

4. The apparatus of claim 1 wherein the first direction is orthogonal to the second direction.

5. The apparatus of claim 1 further comprising:

a second guide rail coupled to the wall surface and extending parallel to the first plane from a second interior position on the wall surface towards an intersection of the far-right edge and the uppermost edge;

a second slider configured to move along the second guide rail parallel to the first plane;

a second corner panel coupled to the second slider;

a third side panel coupled to the second corner panel and configured with the interior back wall to move horizontally relative to the interior back wall in a fourth direction that is parallel to the first plane to exert a fourth force parallel to the first plane and in the fourth direction to the second slider;

the second side panel coupled to the second corner panel and configured with the interior back wall to move vertically relative to the interior back wall in the second direction to exert a fifth force parallel to the first plane and in the second direction to the second slider;

the second side panel configured to move in the second direction and the third side panel configured to move in the fourth direction simultaneously;

the expansion control mechanism configured with the second side panel to move the second side panel relative to the interior back wall in the second direction and with the third side panel to simultaneously move the third side panel relative to the interior back wall in the fourth direction;

wherein simultaneous movement of the second side panel in the second direction and the third side panel in the fourth direction causes the fourth force and the fifth force to combine resulting in a sixth force applied to the second slider in a fifth direction;

wherein the sixth force when applied to the second slider causes the second slider and the second corner panel to move along the second guide rail;

wherein the interior back wall, the second side panel, the third side panel, and the second corner panel define a second inner volume of the container;

wherein movement of the second side panel in the second direction and movement of the third side panel in the fourth direction and movement of the second corner panel along the second guide rail causes the second inner volume of the container to expand.

6. The apparatus of claim 5 wherein the fourth direction is orthogonal to the second direction.

7. The apparatus of claim 5 wherein the third side panel includes a third side panel guide rail, and the second corner panel includes a fifth slider configured to move along the second side panel guide rail during movement of the second corner panel along the second guide rail.

8. The apparatus of claim 7 wherein the third side panel guide rail is vertical.

9. The apparatus of claim 5 wherein the second side panel includes a fourth side panel guide rail, and the second corner panel includes a sixth slider configured to move along the fourth side panel guide rail during movement of the second corner panel along the second guide rail.

10. The apparatus of claim 9 wherein the fourth side panel guide rail is horizontal.

11. The apparatus of claim 5 wherein the fourth direction is opposite the first direction.

12. The apparatus of claim 5 wherein the third side panel is opposite the first side panel.

13. The apparatus of claim 1 wherein the first interior position and/or the second interior position is in a middle of the interior back wall.

14. The apparatus of claim 1 wherein the first side panel guide rail is vertical.

15. The apparatus of claim 3 wherein the second side panel guide rail is horizontal.

16. An expandable container apparatus comprising:

a container including an interior back wall including an uppermost edge, a lowermost edge opposite the uppermost edge, a far-left edge, and a far-right edge opposite the far-left edge, and a wall surface extending between the uppermost edge, the lowermost edge, the far-left edge, and the far-right edge;

a first guide rail coupled to the wall surface and extending from first interior position on the wall surface towards an intersection of the far-left edge and the uppermost edge;

a first slider configured to move along the first guide rail;

a first corner panel coupled to the first slider;

a first side panel coupled to the first corner panel and configured with the interior back wall to move relative to the interior back wall in a first direction to exert a first force in the first direction to the first slider;

a second side panel coupled to the first corner panel and configured with the interior back wall to move vertically relative to the interior back wall in a second direction to exert a second force in the second direction to the first slider, the first side panel configured to move in the first direction and the second side panel configured to move in the second direction simultaneously;

an expansion control mechanism configured with the first side panel to move the first side panel relative to the interior back wall in the first direction and with the second side panel to simultaneously move the second side panel relative to the interior back wall in the second direction;

wherein simultaneous movement of the first side panel in the first direction and the second side panel in the second direction causes the first force and the second force to combine resulting in a third force applied to the first slider in a third direction;

wherein the third force when applied to the first slider causes the first slider and the first corner panel to move along the first guide rail;

wherein the first side panel includes a first side panel guide rail, and the first corner panel includes a third slider configured to move along the first side panel guide rail during movement of the first corner panel along the first guide rail;

wherein the interior back wall, the first side panel, the second side panel, and the first corner panel define a first inner volume of the container;

wherein movement of the first side panel in the first direction and movement of the second side panel in the second direction and movement of the first corner panel along the first guide rail causes the first inner volume of the container to expand.

17. The apparatus of claim 16 wherein the first direction is orthogonal to the second direction.

18. The apparatus of claim 16 wherein the first side panel guide rail is vertical.

19. The apparatus of claim 16 wherein the second side panel includes a second side panel guide rail, and the first corner panel includes a fourth slider configured to move along the second side panel guide rail during movement of the first corner panel along the first guide rail.

20. The apparatus of claim 19 wherein the second side panel guide rail is horizontal.

* * * * *